US007731558B2

(12) United States Patent
Capriola

(10) Patent No.: US 7,731,558 B2
(45) Date of Patent: Jun. 8, 2010

(54) ILLUMINATED TOY BUILDING STRUCTURES

(76) Inventor: Jon Capriola, P.O. Box 22003, Sarasota, FL (US) 34276

( * ) Notice: Subject to any disclaimer, the term of this patent is extended or adjusted under 35 U.S.C. 154(b) by 146 days.

(21) Appl. No.: 11/839,444

(22) Filed: Aug. 15, 2007

(65) Prior Publication Data

US 2009/0047863 A1 Feb. 19, 2009

(51) Int. Cl.
*A63H 33/04* (2006.01)

(52) U.S. Cl. ..... 446/91; 446/92; 446/124; 446/485; 273/120 A; 273/120 R; 273/441; 439/581

(58) Field of Classification Search ..... 439/581; 446/91, 92, 485, 124; 273/120 A, 120 R, 273/441
See application file for complete search history.

(56) References Cited

U.S. PATENT DOCUMENTS 2,416,959 A * 3/1947 Herzl ..... 434/259
2,923,550 A * 2/1960 Blackman et al. ..... 273/157 R
2,983,071 A * 5/1961 Stewart ..... 446/92
3,237,341 A * 3/1966 Janning ..... 446/91
3,447,249 A * 6/1969 Greger ..... 434/224
3,484,984 A * 12/1969 Fischer ..... 446/91
3,553,883 A * 1/1971 Fischer ..... 446/91
3,589,056 A * 6/1971 Glass et al. ..... 446/91
3,634,678 A * 1/1972 Glass et al. ..... 362/567
3,696,548 A * 10/1972 Teller ..... 446/91
3,804,411 A 4/1974 Hendry
4,002,893 A * 1/1977 Newcomb et al. ..... 473/570
4,109,398 A * 8/1978 Hida ..... 434/370
4,305,221 A * 12/1981 Chatani ..... 446/121
4,306,373 A * 12/1981 Chatani et al. ..... 446/121
4,509,929 A * 4/1985 Zawitz ..... 446/102
4,552,541 A * 11/1985 Bolli ..... 446/91
4,556,393 A * 12/1985 Bolli ..... 446/91
4,619,625 A * 10/1986 Seki et al. ..... 446/89
4,629,192 A * 12/1986 Nichols ..... 273/156
4,667,277 A * 5/1987 Hanchar ..... 362/249.01
4,869,701 A * 9/1989 Kawai et al. ..... 446/91
4,915,666 A * 4/1990 Maleyko ..... 446/242
4,989,881 A * 2/1991 Gamble ..... 473/570

(Continued)

FOREIGN PATENT DOCUMENTS

KR 10-1990-0001823 B1 3/1990

(Continued)

*Primary Examiner*—Gene Kim
*Assistant Examiner*—Alexander R Niconovich
(74) *Attorney, Agent, or Firm*—Allen Dyer Doppelt Milbrath & Gilchrist

(57) ABSTRACT

The present device is an illuminated building block device that mimics the look of a laser. The building block includes a non-opaque body comprising at least two mechanical connectors. At least two electrically independent conductors each traverse the body from each connector to each other connector. At least one LED is electrically connected to at least two of the electrical conductors. With at least two building blocks mechanically connected, a power source may be applied to one of the connectors of one of the building blocks to illuminate each LED. Preferably, the body of the building block is generally transparent and is capable of transmitting light from a colored LED to a connected block, thus mimicking the look of a laser. The invention also comprises a set of building blocks that permits light from an LED to pass from one connected block to an adjacent connected block.

27 Claims, 4 Drawing Sheets

U.S. PATENT DOCUMENTS 4,998,903 A * 3/1991 Bolli et al. ..... 446/102
5,054,778 A * 10/1991 Maleyko ..... 473/570
5,241,875 A * 9/1993 Kochanneck ..... 74/490.03
5,458,522 A * 10/1995 Brooks, III ..... 446/85
5,545,070 A * 8/1996 Liu ..... 446/104
5,826,872 A * 10/1998 Hall ..... 273/156
5,833,465 A * 11/1998 Jarzewiak ..... 434/171
5,848,503 A * 12/1998 Toft et al. ..... 52/173.1
5,853,314 A * 12/1998 Bora ..... 446/120
5,902,166 A * 5/1999 Robb ..... 446/47
5,924,906 A * 7/1999 Grafton ..... 446/121
6,050,044 A * 4/2000 McIntosh ..... 52/591.1
6,062,937 A * 5/2000 Kikuchi ..... 446/91
6,082,876 A 7/2000 Hanson et al.
6,086,444 A * 7/2000 Glickman ..... 446/124
6,135,606 A * 10/2000 Fernandez et al. ..... 362/109
6,238,261 B1 * 5/2001 Lang ..... 446/219
6,428,432 B1 8/2002 Kachel
6,482,136 B1 11/2002 Kessler
6,491,563 B1 * 12/2002 Bailey ..... 446/122
6,561,866 B1 * 5/2003 Lee ..... 446/90
6,585,553 B1 * 7/2003 Fetridge et al. ..... 446/91
6,626,727 B2 * 9/2003 Balanchi ..... 446/85
6,679,751 B1 * 1/2004 Maxwell et al. ..... 446/91
6,846,216 B1 * 1/2005 Balanchi ..... 446/85
7,063,587 B1 * 6/2006 Lin ..... 446/124
7,255,624 B2 * 8/2007 Daftari ..... 446/92
7,322,873 B2 * 1/2008 Rosen et al. ..... 446/91
D580,995 S * 11/2008 Chun ..... D21/499
7,507,136 B2 * 3/2009 Patton ..... 446/92
2002/0115373 A1 * 8/2002 Lazerman ..... 446/85
2003/0040250 A1 * 2/2003 Yim et al. ..... 446/91
2003/0148700 A1 * 8/2003 Arlinsky et al. ..... 446/91
2004/0018473 A1 * 1/2004 Tusacciu ..... 434/73
2004/0063380 A1 * 4/2004 Chi et al. ..... 446/220
2004/0185745 A1 * 9/2004 Reining et al. ..... 446/91
2006/0084357 A1 * 4/2006 Rosen et al. ..... 446/91
2006/0134978 A1 * 6/2006 Rosen et al. ..... 439/581
2007/0200289 A1 * 8/2007 Morikawa et al. ..... 273/120 A
2008/0139077 A1 * 6/2008 Patton ..... 446/92
2008/0160875 A1 * 7/2008 Leicht ..... 446/124

FOREIGN PATENT DOCUMENTS

KR 10-2005-0035986 A 4/2005

* cited by examiner

ILLUMINATED TOY BUILDING STRUCTURES

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to building blocks, and more particularly to an illuminated building block system.

BACKGROUND OF THE INVENTION

Building blocks have been around for generations. Children enjoy playing with building blocks. Building blocks allow children to use their imagination to create a variety of structures.

Over the years, building blocks have come in many different styles. Traditionally, blocks were designed that did not interconnect buy merely placed on top of one another to build structures. Later interconnected blocks were developed that allowed children to create structures with a greater variety of shapes.

Children also enjoy playing with toys with brightly colored lights. Devices exist that illuminate plastic beads which children can use to create a variety of designs. However, these devices are typically designed to create a 2-dimensional design or picture.

Children also enjoy toys that stimulate their imagination, especially toys that allow them to imagine they are playing with a device they are not normally allowed to play with, such as a laser. Lasers can be dangerous for children, but are exciting to children as they are brightly colored and represent the forefront of technology.

Therefore, there is a need for a device that provides building blocks incorporating a variety of colored lights that can mimic the look of a laser and can be interlocked to make a variety of multi-colored 3-dimensional shapes. The present invention accomplishes these objectives.

SUMMARY OF THE INVENTION

The present device is an illuminated building block device that mimics the look of a laser. The building block includes a non-opaque body comprising at least two mechanical connectors. At least two electrically independent conductors each traverse the body from each connector to each other connector. At least one light emitting diode (LED) is electrically connected to at least two of the electrical conductors. With at least two building blocks mechanically connected, a power source may be applied to one of the connectors of one of the building blocks to illuminate each LED.

The body includes at least one male connector and one female connector, whereby adjoin building blocks are interconnected by connecting the male connector of a first block to the female connector of a second block. Preferably, each male connector includes at least one elastomeric ring facilitating a removable but well secured connection between adjoining building blocks. In a preferred embodiment, the body is generally transparent and is capable of substantially transmitting light via the mechanical connectors of two connected blocks, thus mimicking the look of a laser.

Using an LED provides many advantages. LEDs can mimic the look of a laser, as LEDs can be designed to focus light of a chosen color, similar to a laser. Also, LEDs have long life spans. In a preferred embodiment, the body of the building block is of a substantially transparent non-colored material and the color of each LED is easily seen when powered.

Each of the at least two electrically independent conductors allow electric current to pass from one building block to the next building block. As each additional building block is connected the electric current from a power source is transferred from building block to building block via the conductors. The power source can be either external or internal to the building blocks. In a preferred embodiment, the electric current flows from a male connector of one building block to a female connector of the adjoining interconnected building block. The body of the building block can be of a multitude of shapes including: cylindrical, rectangular, cylindrical with an 90-degree bend, and in the form of a wheel.

The body can include an electrical switch electrically connected to the conductors and electrically disposed between each of the connectors. In one embodiment, the switch permits the user to activate each LED independently. In an alternate embodiment, the electrical switch permits the user to prevent power being transferred beyond a selected building block. The body can include a battery disposed therein. With each end of the battery connected to one of the conductors, the battery is capable of illuminating the LED.

The invention also comprises a set of building blocks. The set of building blocks includes at least one block having a non-opaque body comprising at least two mechanical connectors. At least two electrical independent conductors each traverse the body from each connector to each other connector. At least one LED is disposed within the body and electrically connected to at least two of the electrical conductors. At least one power source of the set has a body comprising at least one mechanical connector with at least two electrical independent conductors each traversing the body from each connector to a battery. The battery connects at either end to one of the conductors; and an electrical switch electrically is disposed between one end of the battery and each connector. When the at least one block and the at least one power source are connected at their mechanical connectors, the LED of the at least one block may be powered by the battery of the at least one power source.

At least one block of the set has a body comprising at least two mechanical connectors and at least two electrical independent conductors with each conductor traversing the body from each connector to each other connector. This embodiment provides the option of a block without an LED within, but still providing a path for an electric current to conduct from one connected block to the next connected block. In a preferred embodiment, the at least one block without an LED is generally transparent and substantially transmits light from at least one adjacent mechanically connected block to at least one other adjacent mechanically connected block. This embodiment permits light from an LED to pass from connected block to an adjacent connected block providing the look of a laser.

At least one block of the set has a non-opaque body comprising one mechanical connector, at least two electrical independent conductors each traversing the body from the connector to at least one LED disposed with the body and electrically connected to at least two of the electrical conductors. This embodiment provides the option of a block with only one mechanical connector thereby acting as an end piece to the set of building blocks.

The present device is a device that provides building blocks incorporating a variety of colored lights that can mimic the look of a laser and can be interlocked to make a variety of multi-colored 3 dimensional shapes. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
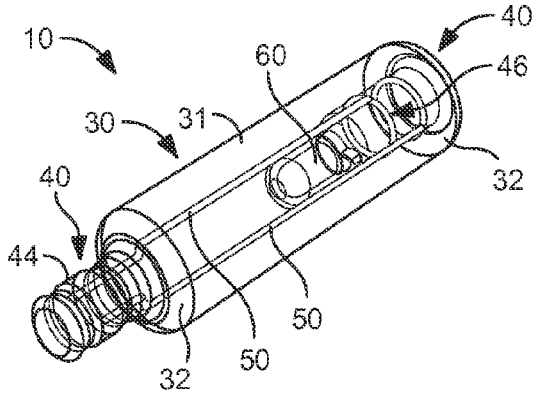
FIG. 1 is a perspective view of the invention, illustrating a cylindrical embodiment of a building block.
Figure 2:
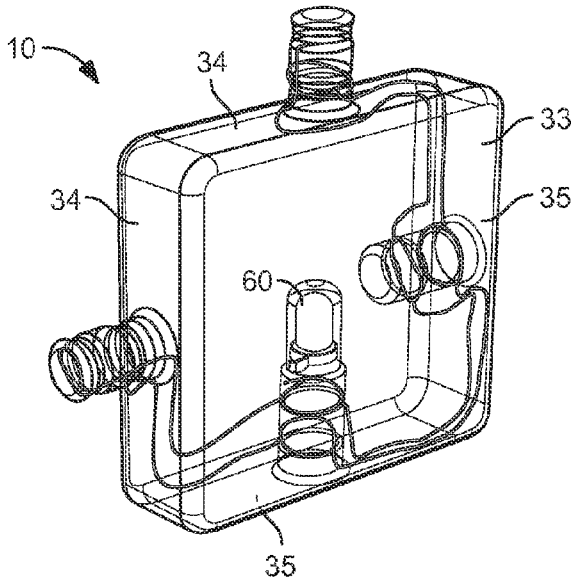
FIG. 2 is a perspective view of the invention, illustrating a rectangular box embodiment of a building block.

With respect to the drawings, FIGS. 1 and 2 illustrate a building block 10. The building block 10 includes a non-opaque body 30 comprising at least two mechanical connectors 40. At least two electrically independent conductors 50 each traverse the body 30 from each connector 40 to each other connector 40. At least one LED 60 electrically is connected to at least two of the electrical conductors 40. With at least two building blocks 10 mechanically connected, a power source 70 may be applied to one of the connectors 40 of one of the building blocks 10 to illuminate each LED 60. A resistor (not shown) may be included electrically in series with each LED 60 to balance voltage drops between different types or colors of LEDs 60.

Figure 6:
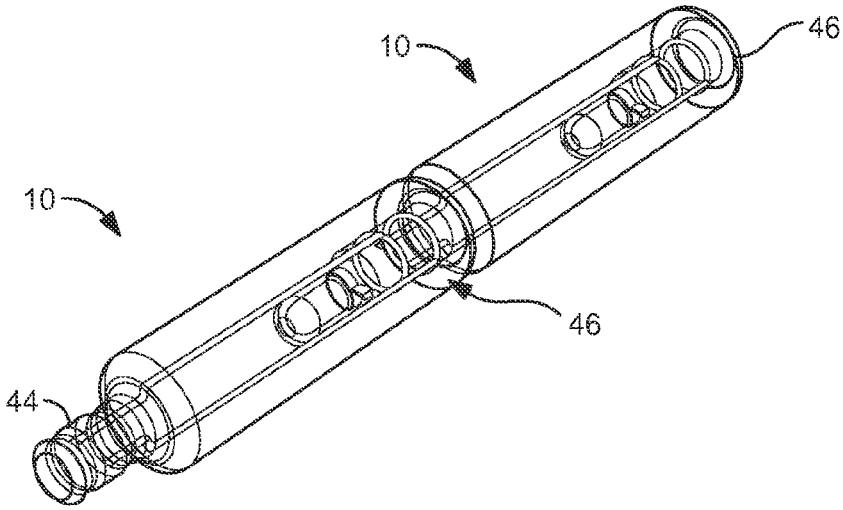
FIG. 6 is a perspective view of the invention, illustrating two cylindrical building blocks connected to each other.

In a preferred embodiment illustrated in FIGS. 1 and 6, the body 30 includes at least one male connector 44 and one female connector 46, whereby adjoin building blocks 10 are interconnected by connecting the male connector 44 of a first block 10 to the female connector 46 of a second block. Preferably, each male connector 44 includes at least one elastomeric ring 90 (FIG. 5D) facilitating a removable but well-secured connection between adjoining building blocks 10. In an alternate embodiment, the male connector 44 includes a threaded end (not shown) that would screw into the female connector 46 to provide a removably secured connection.

In one embodiment, the body 30 is generally transparent and is capable of substantially transmitting light to a mechanically connected adjoining block 10. In a preferred embodiment, the body 30 is generally transparent and is capable of substantially transmitting light via the mechanical connectors 40 of two connected blocks 10, thus mimicking the appearance of a laser (FIG. 6).

The body 30 is preferably made from a light weight, durable, rigid, and non-opaque material such as acrylic, but can also be formed from any suitable rigid, durable, non-opaque material, such as a rigid plastic material, if desired. Durable but flexible non-opaque materials could also be used to facilitate the building of a greater variety of structures from the building blocks 10. Also, the non-opaque material can be made of different colors to make the invention more attractive and add variety.

Using an LED 60 provides many advantages. LEDs can mimic the look of a laser, as LEDs can be designed to focus light of a chosen color, similar to a laser. Also, LEDs have long life spans. Preferably, standard commercially available LEDs would be used to minimize the cost of production. In a preferred embodiment, the body 30 of the building block 10 is of a substantially transparent non-colored material and the color of each LED 60 is easily seen when powered. This embodiment mimics the look of laser as colored light passes from one building block 10 to the next building block 10 (FIG. 6). In a preferred embodiment, each LED 60 is aligned in the same direction as the male connector 44. In an alternate embodiment, the LED 60 can be aligned to face any desired direction within the building block 10.

In an alternate embodiment, each LED 60 produces a white light that illuminates the color of the building block 10. In another alternate embodiment, each LED 60 is of a color that will interact with the color of the building block 10 to produce a third color when each LED 60 is powered. The body 30 can be substantially solid or can be substantially hollow, whereby a more solid or a more hollow body can be used to achieve a desired interaction with the light from each LED 60. Each LED 60 of each building block 10 can be of different sizes or colors.

Each of the at least two electrically independent conductors 50 allow electric current to pass from one building block 10 to the next building block 10. As each additional building block 10 is connected, the electric current from the power source 70 is transferred from building block 10 to building block 10 via the conductors 50. The power source 70 can be either external or internal to the building blocks 10. In a preferred embodiment, the electric current flows from a male connector 44 of one building block 10 to a female connector 46 of the adjoining interconnected building block 10 (FIG. 5D). Optionally a conductive ring 52 may be connected to each conductor 50 at the connectors 44,46 to facilitate electrical connections between two adjoining blocks 10 (FIG. 5D).

In one embodiment, the at least two electrically independent conductors 50 are designed to be incorporated as a decorative aspect of the invention. In another embodiment, each conductor 50 runs along the outer portion of the non-opaque building block 10. Each electrically independent conductor 50 is preferably of a different color to indicate a different polarity between each conductor 50. Also, using different colors for each conductor 50 adds to the decorative appeal and enjoyment of a user, typically being a child.

Figure 3:
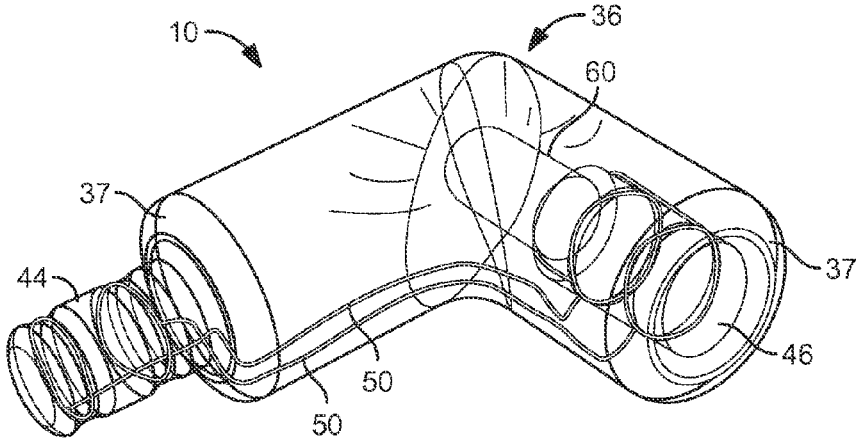
FIG. 3 is a perspective view of the invention, illustrating a cylindrical embodiment of a building block with a 90-degree bend.
Figure 4:
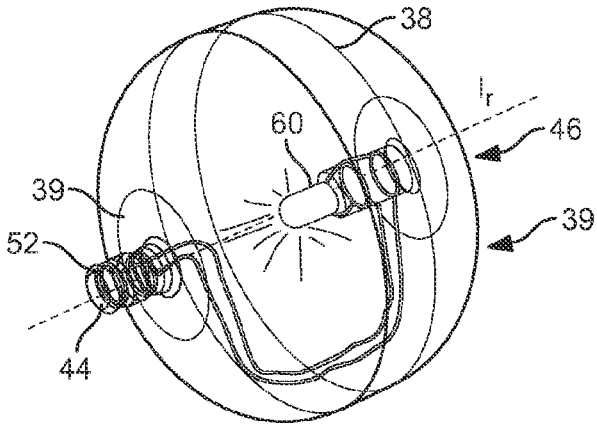
FIG. 4 is a perspective view of the invention, illustrating a wheel embodiment of a building block.

In the embodiment illustrated in FIG. 1, the body 30 is substantially cylindrical 31 with one of the mechanical connectors at either end 32 thereof. In the embodiment illustrated in FIG. 2, the body 30 is a rectangular box 33 having the male connector 44 on two sides 34 thereof, and the female connector on two other sides 35 thereof. In the embodiment illustrated in FIG. 3, the body 30 is cylindrical with an approximately 90-degree bend 36 and two of the mechanical connectors 40 at either end 37 thereof. Such a body 30 preferable does not include an LED 60, but is illustrated with an LED 60. In the embodiment illustrated in FIG. 4, the body takes the form of a wheel 38, with a connector 40 on either side 39 along a rotational axis $l_r$ thereof This embodiment permits a user to create a wheeled structure resembling a vehicle (FIGS. 7 and 8).

Figure 5C:
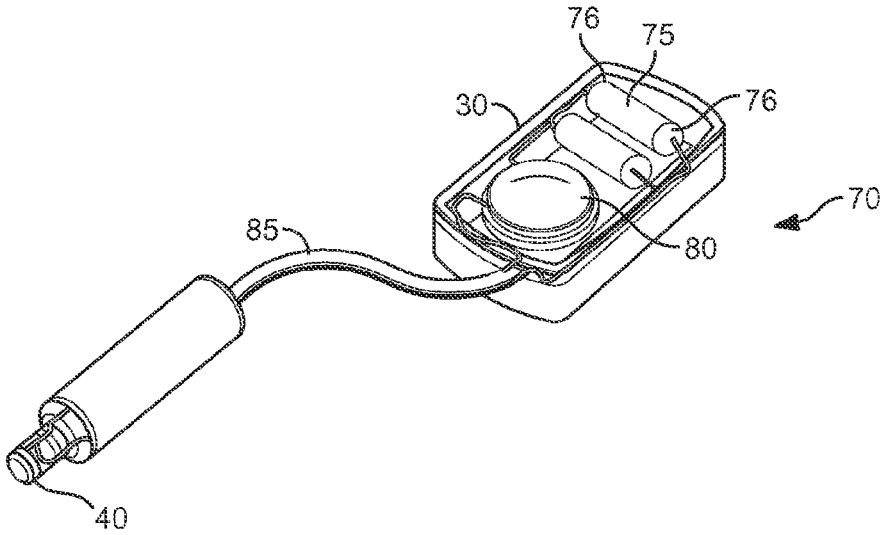
FIG. 5C is a perspective view of the invention, illustrating a power source with a an electrical switch and battery disposed therein.
Figure 5A:
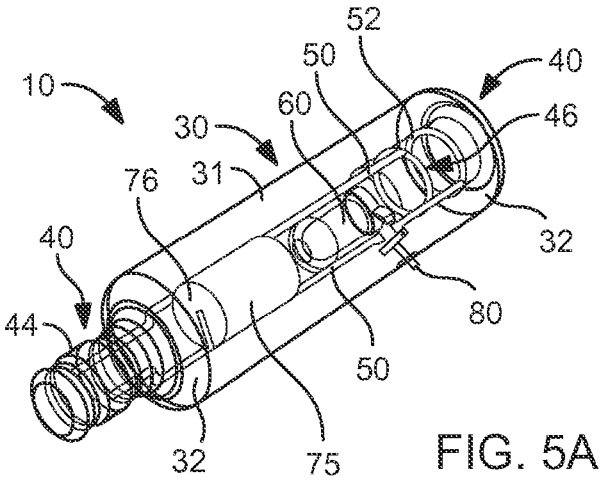
FIG. 5A is a perspective view of the invention, illustrating a building block with a electrical switch and battery disposed therein.
Figure 5B:
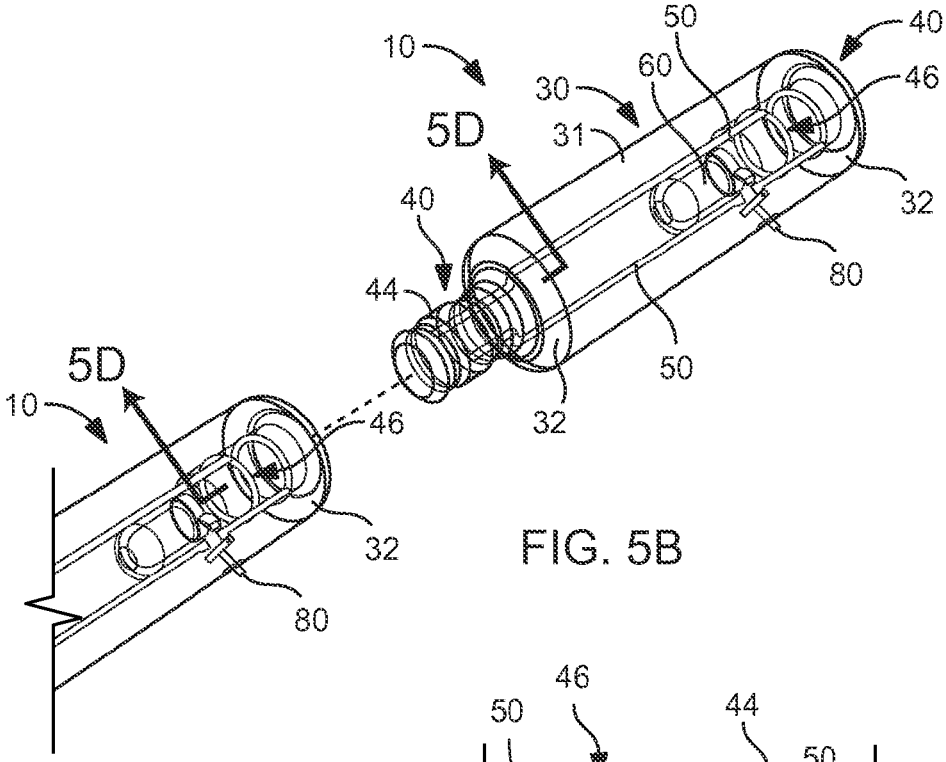
FIG. 5B is a perspective view of the invention, illustrating a building block with an electrical switch.
Figure 5D:
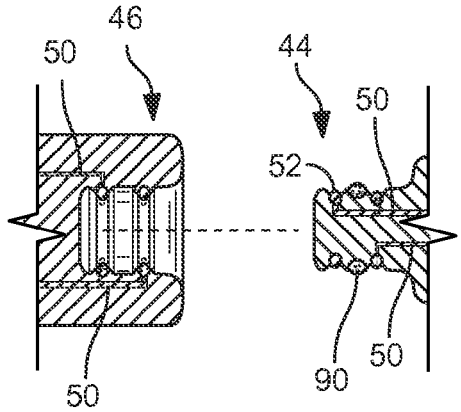
FIG. 5D is a cross-sectional view of the invention, taken along lines 5D-5D of FIG. 5B, illustrating a male and a female connector of two blocks and internal conductors of the invention.

In one embodiment of the invention illustrated in FIGS. 5A, 5B, and 5C, the body 30 further includes an electrical switch 80 electrically connected to the conductors 50 and electrically disposed between each of the connectors 40. In one embodiment, the electrical switch 80 controls the flow of power to each LED 60 but does not control the flow of power from one connecter 40 of the building block 10 to another connector 40, thereby permitting uninterrupted power to flow across the building block 10 whether or not each LED 60 receives power. This embodiment permits the user to activate each LED 60 independently when multiple building blocks 10 are interconnected. In an alternate embodiment, the electrical switch 80 controls the flow of power across the building block 10 from one connector 40 of the building block 10 to another connector 40. This embodiment permits the user to prevent power being transferred beyond a selected building block 10. In an embodiment of a building block 10 with more than two connectors 40, the building block 10 can contain multiple switches 80 to selectively control the flow of power (not shown).

In an alternate embodiment of the invention illustrated in FIG. 5A, the body further includes a battery 75 disposed therein, each end 76 of the battery connected to one of the conductors 50, the battery 75 capable of illuminating each LED 60. In another embodiment, the body 30 further includes the electrical switch 80 electrically disposed between one end of the battery 75 and each of the connectors 40.

Figure 7:
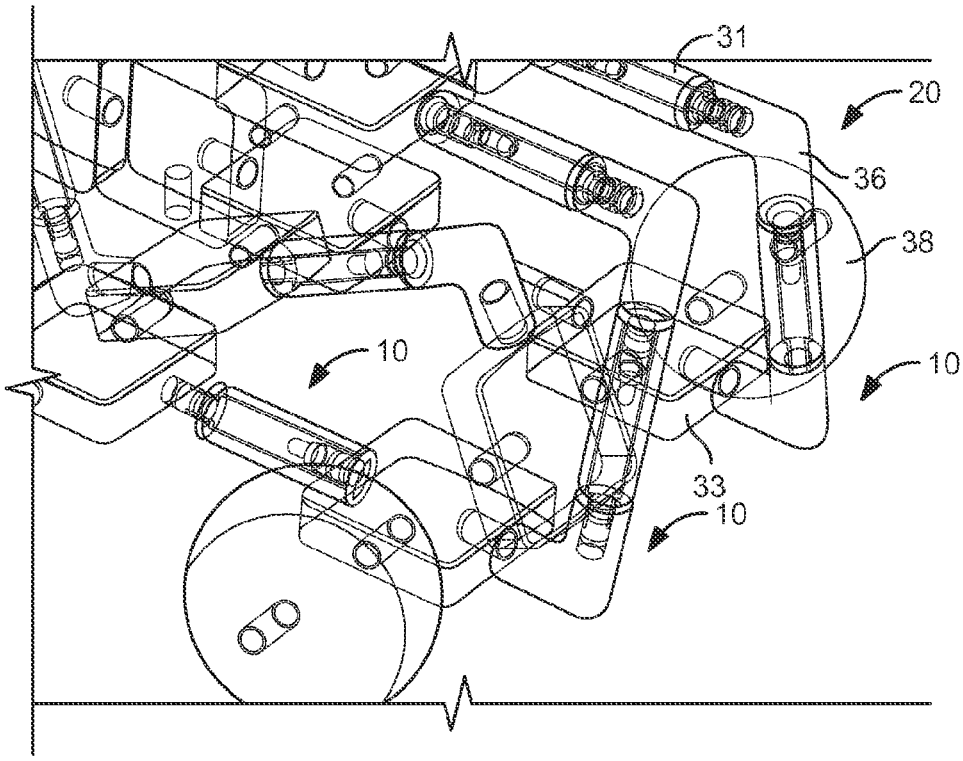
FIG. 7 is a perspective view of the invention, illustrating a set of building blocks.
Figure 8:
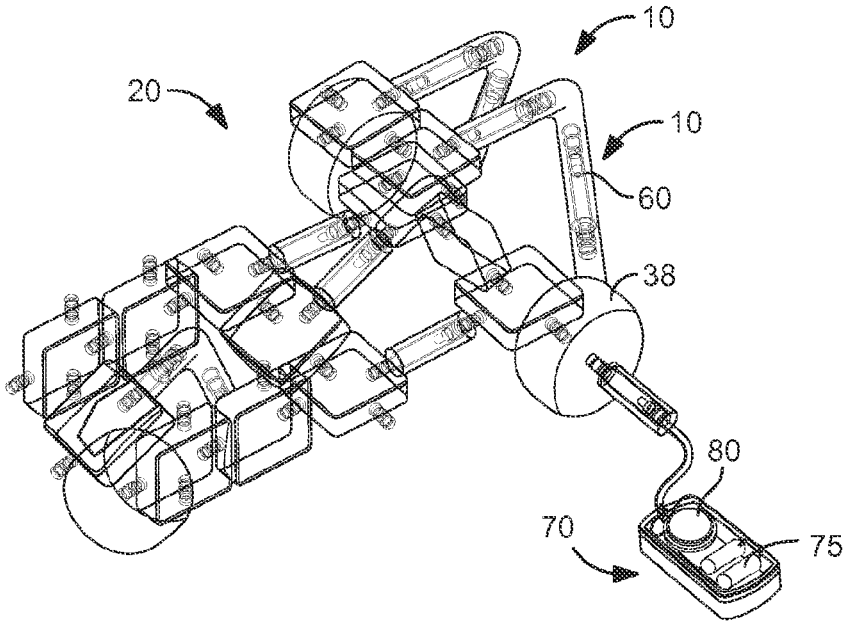
FIG. 8 is a perspective view of the invention, illustrating the power source connected to a set of building blocks.

With respect to the drawings, FIGS. 7 and 8 illustrate a set 20 of building blocks 10. The set 20 of building blocks 10 includes at least one block 10 having a non-opaque body 30 comprising at least two mechanical connectors 40. At least two electrical independent conductors 50 each traverse the body 30 from each connector 40 to each other connector 40. At least one LED 60 is disposed within the body 30 and electrically connected to at least two of the electrical conductors 50.

As illustrated in FIG. 5C, at least one power source 70 of the set 20 has a body 30 comprising at least one mechanical connector 40 with at least two electrical independent conductors 50 each traversing the body 30 from each connector 40 to a battery 75. The battery 75 connects at either end 76 to one of the conductors 50; and an electrical switch 80 is electrically disposed between one end of the battery 75 and each connector 40. In one embodiment, the at least one mechanical connector 40 is connected to the electrical switch 80 via a conductor wire 85 (FIG. 5C). In another embodiment, power source 70 utilizes three standard AA-type batteries to form a triangular-shaped block 10 (not shown).

When the at least one block 10 and the at least one power source 70 are connected at their mechanical connectors 40, the LED 60 of the at least one block 10 may be powered by the battery 75 of the at least one power source 70. In the embodiment illustrated in FIG. 8, the set 20 of building blocks 10 includes only one power source 70, whereby power to the entire set 20 of building blocks 10 can be centrally controlled.

In another embodiment of the set 20, at least one block 10 has a body 30 comprising at least two mechanical connectors 40 and at least two electrical independent conductors 50 with each conductor 50 traversing the body 30 from each connector 40 to each other connector 40. This embodiment provides the option of a block 10 without an LED 60 within, but still providing a path for an electric current to conduct from one connected block 10 to the next connected block 10. In a preferred embodiment, the at least one block 10 without an LED 60 is generally transparent and substantially transmits light from at least one adjacent mechanically connected block 10 to at least one other adjacent mechanically connected block 10. This embodiment permits light from an LED to pass from connected block 10 to an adjacent connected block 10 providing the look of a laser. This embodiment further permits a user to observe the effects of connecting blocks 10 with different colored LEDs 60 to a block 10 with no LED 60 to see if the different colored LEDs 60 will create a third color when combined.

In another embodiment of the set 20, at least one block 10 has a non-opaque body 30 comprising one mechanical connector 40, at least two electrical independent conductors 50 each traversing the body 30 from the connector 40 to at least one LED 60 disposed with the body 30 and electrically connected to at least two of the electrical conductors 50. This embodiment provides the option of a block 10 with only one mechanical connector 40, thereby acting as an end piece to the set 20 of building blocks 10. This embodiment provides a protective advantage of covering all male connectors 44 of the building blocks 10 and provides an esthetic advantage of giving a structure built with the set 20 of building blocks 10 a finished or completed look.

While a particular form of the invention has been illustrated and described, it will be apparent that various modifications can be made without departing from the spirit and scope of the invention. For example, the building blocks 10 can be used to create decorative structures to be used as holiday decorations or worn as jewelry. Accordingly, it is not intended that the invention be limited, except as by the appended claims.

What is claimed is:

1. A building block comprising:

a non-opaque body comprising at least two mechanical connectors, at least one of the connectors of the body comprising a male connector and at least one of the other connectors of the body comprising a female connector;

two electrical conductors each traversing the body from each connector to each other connector;

at least one LED within the body and electrically connected across the two conductors;

each connector having a housing coupled to the two conductors so as to close a circuit between the conductors and illuminate the LED upon application of a power source to the connector and also transmit power to each other connector of the body along the two conductors; and whereby with at least two of the building blocks mechanically connected, a power source applied to any one of the connectors of either of the building blocks illuminates each LED.

2. The structure of claim 1 wherein the body is generally transparent and is capable of substantially transmitting light to a mechanically connected adjoining block.

3. The structure of claim 2 wherein the body is generally transparent and is capable of substantially transmitting light via the mechanical connectors of two connected blocks.

4. The structure of claim 1 wherein the body includes opposing first and second sides with the male connector extending outwardly from the body along the first side and the female connector extending inwardly into the body from the second side in a direction axial with the male connector.

5. The structure of claim 4 wherein the body is substantially cylindrical with the mechanical connectors at opposite ends thereof.

6. The structure of claim 4 wherein the body is a rectangular box having male connectors on two sides thereof and female connectors on two other sides thereof, each of the female connectors axially aligned with a corresponding one of the male connectors.

7. The structure of claim 1 wherein the body is cylindrical with an approximately 90-degree bend and the mechanical connectors at opposite ends thereof.

8. The structure of claim 1 wherein the body takes the form of a wheel, with the male connector and the female connector on opposite sides along a rotational axis thereof.

9. The structure of claim 1 further comprising an external power source and an electrical switch electrically coupled with the connectors.

10. The structure of claim 9 wherein the external power source and the external switch are fitted together in an external power source container, with an electrical connection coupled between the power source container and the connectors for the building block.

11. The structure of claim 10 further comprising the electrical switch electrically disposed between one end of the power source and each of the connectors.

12. A building block set comprising:

at least two blocks each having a non-opaque body and each having at least two mechanical connectors, one of which is a male connector and the other of which is a female connector, at least two electrically conductors each traversing the respective body from each connector to each other connector and at least one LED disposed within each body and electrically connected to the two electrical conductors of the respective body;

a power source unit having at least one mechanical connector and at least two electrically conductors each traversing the power source unit from each connector of the power source unit to a battery, the battery connected at either end to one of the conductors;

an electrical switch electrically disposed between one end of the battery and one of the connectors of the power source unit;

each connector having a housing coupled to the two conductors so as to close a circuit between the conductors and illuminate the LED upon application of a power source to the connector and also transmit power to each other connector of the body along the two conductors; and whereby when the blocks and the power source unit are connected at just one of the mechanical connectors of each block, the LEDs of all of the blocks are powered by the battery.

13. The set of claim 12 wherein at least one of the blocks being rectangular and having first and second opposing sides with the male mechanical connector attached to and extending laterally away from the first side and with the female mechanical connector attached with and extending inwardly into the rectangular block from the second side.

14. The set of claim 13 wherein the rectangular block further comprises third and fourth opposing sides, with a second male mechanical connector attached with and extending laterally away from the third side and with a second female mechanical connector attached with and extending inwardly into the rectangular block from the fourth side.

15. The set of claim 14 further comprising at least one of the blocks having a cylindrical shape with first and second opposing ends and with a male mechanical connector attached to and extending axially outwardly from a first end and a female mechanical connector attached at a second, opposing end and extending axially inwardly into the cylindrical block.

16. The building block of claim 4 wherein the male connector extends generally orthogonally away from the first side, and the female connector extends inwardly into the body generally orthogonally from the second side.

17. The building block of claim 1 wherein the two conductors are electrically coupled with the male and female connectors and the LED so that uninterrupted power flows between the connectors irrespective of whether the LED is operational.

18. An illuminated toy building block set comprising:

at least one rectangular block having first and second opposing sides and third and fourth opposing sides, with an electrically conductive male mechanical connector attached with and extending laterally away from each of the first and third sides, and with an electrically conductive female mechanical connector attached with and extending inwardly into the rectangular block from each of the second and fourth sides;

at least one cylindrical block having first and second opposing ends with an electrically conductive male mechanical connector attached at and extending axially from the first end and an electrically conductive female mechanical connector attached at the second end and extending axially inwardly into the cylindrical block;

an LED fitted within each block;

each connector having a housing coupled to the two conductors so as to close a circuit between the conductors and illuminate the LED upon application of a power source to the connector and also transmit power to each other connector of the body along the two conductors; means for conducting electrical current through the LED in each block and each of the electrically conductive mechanical connectors of each block; and wherein the electrically conductive male mechanical connectors and the electrically conductive female mechanical connectors of each block is dimensioned so that all of the male connectors are interconnectable with the female connectors of other blocks in an electrically conductive manner.

19. The toy building block set recited in claim 18 wherein the rectangular block comprises the mechanical connectors of the first and third sides are positioned in axial alignment and the mechanical connectors of the second and fourth sides are positioned in axial alignment.

20. The toy building block set recited in claim 18 wherein the means for conducting electrical current further comprises an external power source having an electrical switch for controlling electrical current flow to all of the electrically conductive mechanical connectors for all of the interconnected blocks.

21. The building block set recited in claim 20 wherein the means for conducting electrical current comprises an eternal power source unit having means for permitting interconnection between the power source container and all of the interconnected building blocks.

22. The building block set recited in claim 20 wherein the means for conducting electrical current comprises an external power source unit having means for permitting interconnection between the power source container and each of the building blocks.

23. The building block set recited in claim 18 further comprising at least one elongated block having at least one generally right angle bend and an electrically conductive mechanical connector at a first end and an electrically conductive female mechanical connector at a second end.

24. The illuminated building block set of claim 18 further comprising at least one wheel-shaped block having a rotational axis extending between first and second sides thereof and with an electrically conductive male mechanical connector extending outwardly from a first side of the wheel-shaped block axially along the rotational axis and an electrically conductive female connector extending axially inwardly into the wheel-shaped block along the rotational axis.

25. The illuminated toy building block set recited in claim 18 further comprising:

at least one elongated block having at least one generally right angled bend and an electrically conducted mechanical connector at a first end and an electrically conducted female mechanical connector at a second end; and at least one wheel-shaped block having a rotational axis extending between first and second sides thereof and with an electrically conducted male mechanical connector extending outwardly from a first side of the wheel-shaped block axially along the rotational axis and an electrically conductive female connector extending axially inwardly into the wheel-shaped block from a second side along the rotational axis.

26. An illuminated building block comprising:

a non-opaque body comprising two mechanical connectors, one of the connectors comprising a male connector and the other connector comprising a female connector;

two electrical conductors traversing the body from each connector to each other connector with each connector having a housing coupled to the two conductors so as to close a circuit between the conductors and illuminate the LED upon application of a power source to the connector and also transmit power to each other connector of the body along the two conductors, with all of connectors electrically coupled together within the body;

an LED fitted within the body and electrically connected to the two conductors; and wherein a power source applied to any one connector illuminates the LED.

27. An illuminated building block as recited in claim 26 further comprising each connector receiving the two conductors and closing a circuit between the two conductors and illuminating the LED upon application of a power source to the connector and also transmitting power to each other connector of the body along the two conductors.

* * * * *

(12) INTER PARTES REVIEW CERTIFICATE (43rd)

United States Patent
Capriola

(10) Number: US 7,731,558 K1
(45) Certificate Issued: Nov. 24, 2014

(54) ILLUMINATED TOY BUILDING STRUCTURES

(75) Inventor: Jon Capriola

(73) Assignee: L.P. Investment Holdings, LLC

Trial Numbers:

IPR2013-00120 filed Jan. 23, 2014
IPR2013-00121 filed Jan. 23, 2014

Petitioner: LaRose Industries, LLC

Patent Owner: Capriola Corporation

Inter Partes Review Certificate for:

Patent No.: 7,731,558
Issued: Jun. 8, 2010
Appl. No.: 11/839,444
Filed: Aug. 15, 2007

The results of joined IPR2013-00120 and IPR2013-00121 are reflected in this inter partes review certificate under 35 U.S.C. 318(b).

INTER PARTES REVIEW CERTIFICATE
U.S. Patent 7,731,558 K1
Trial No. IPR2013-00120
Certificate Issued Nov. 24, 2014

AS A RESULT OF THE INTER PARTES REVIEW PROCEEDING, IT HAS BEEN DETERMINED THAT:

Claims 1-27 are cancelled.

* * * * *